US005809572A

United States Patent [19]

Sisolak

[11] Patent Number: 5,809,572

[45] Date of Patent: Sep. 22, 1998

[54] MULTIPLE-LAYER, FORMED FACE MASK FOR USE IN A COLD WEATHER HOOD

[76] Inventor: Edward R. Sisolak, 3805 Marseilles Dr., Mequon, Wis. 53092

[21] Appl. No.: 690,762

[22] Filed: Aug. 1, 1996

[51] Int. Cl.[6] ..... A42B 1/04

[52] U.S. Cl. ..... 2/173; 2/202; 2/424; 2/9; 2/206

[58] Field of Search ..... 2/9, 173, 200.2, 2/202, 203, 206, 410, 424

[56] References Cited

U.S. PATENT DOCUMENTS

| | | | |
|---|---|---|---|
| 3,271,781 | 9/1966 | Sontag et al. . | |
| 3,740,767 | 6/1973 | Schuessler | 173/206 |
| 3,768,100 | 10/1973 | Colman et al. | 2/9 |
| 3,838,467 | 10/1974 | Zientara | 202/173 |
| 4,941,211 | 7/1990 | Blutstein | 202/206 |
| 5,059,452 | 10/1991 | Squires | 428/88 |
| 5,214,804 | 6/1993 | Carey et al. | 2/9 |
| 5,551,087 | 9/1996 | Blutstein et al. | 2/9 |

*Primary Examiner*—Diana Biefeld
*Attorney, Agent, or Firm*—Godfrey & Kahn, S.C.; Brian G. Gilpin

[57] ABSTRACT

A face mask for use in a cold weather hood which may be worn to protect a wearer from the effects of a cold weather environment. The face mask is placed in an opening of the cold weather hood which has predetermined dimensions. The face mask is of multiple-layer construction and, in the preferred embodiment, includes a layer of moldable material sandwiched between two layers of relatively soft material. The layer of moldable material is molded or otherwise formed to substantially conform to the contours of the wearer's face.

14 Claims, 2 Drawing Sheets

Fig. 1
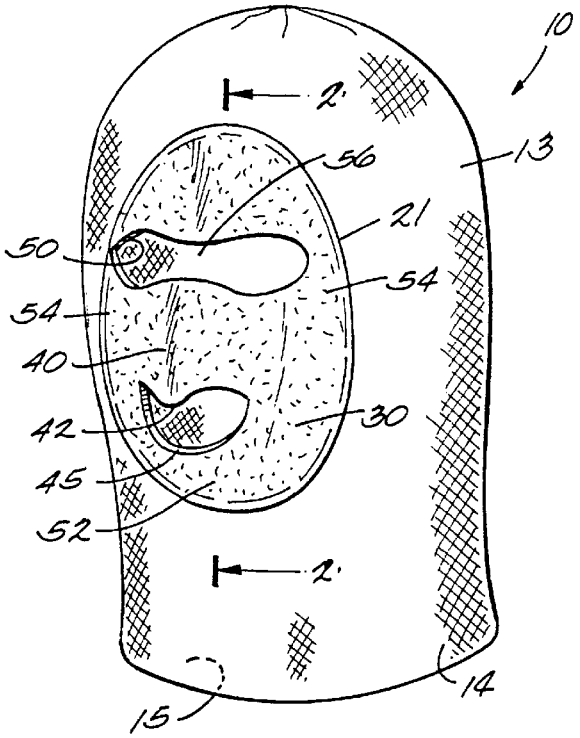
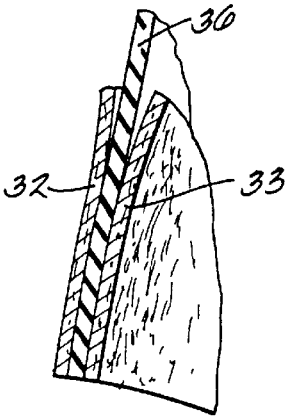
Fig. 3
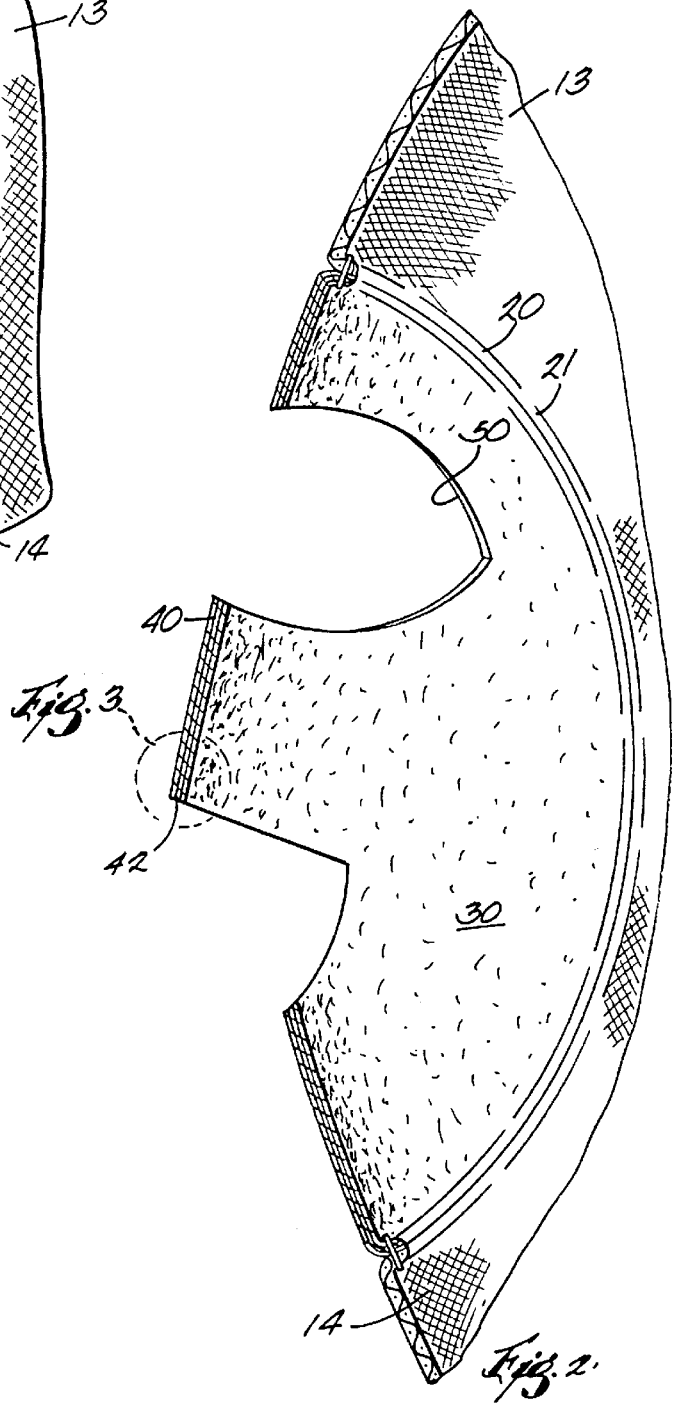
Fig. 3
Fig. 2

MULTIPLE-LAYER, FORMED FACE MASK FOR USE IN A COLD WEATHER HOOD

BACKGROUND OF THE INVENTION

The present invention relates to cold weather clothing, and more particularly to a multiple-layer, formed face mask for use in a cold weather hood. The face mask includes a layer of material which may be formed or shaped to substantially conform to the contours of a human face and, further, insulates and protects the user's face from the effects of cold temperatures.

Cold weather hats or hoods having knitted face masks manufactured from materials such as cotton and various synthetic fibers are known in the art. The hoods have face masks that are typically provided with openings for a wearer's eyes, nose, and mouth.

The knitted materials used in known garments are designed to stretch and mold, to a certain extent, to the contours of the wearer's face. While this stretching characteristic is useful for creating a relatively suitable fit of the hood to the wearer, such stretchable materials are not, in general, impervious to wind. Thus, known hoods fail to provide proper insulation to a wearer's face under high wind conditions. In addition, many wearers find the stretch fit offered by known hoods to be uncomfortable. First, many users do not like the pressure the hoods create on their face when the hood is stretched for wearing. Second, they often find that the hood material stretches in such a way so as to cause a misalignment of the eye, nose, and mouth openings provided in the hood to the user's eyes, nose, and mouth.

There have been some attempts to provide a cold weather hood with molded or shaped components. One such hood includes a relatively hard, molded-plastic nosepiece which is sewn into a face mask. Among other drawbacks, this type of hood tends to cause irritation on a user's face at points corresponding to the stitched seams holding the nose piece to the face mask.

SUMMARY OF THE INVENTION

Therefore it is an object of the present invention to provide an improved face mask for covering a wearer's face and for use in a cold weather hood.

Another object of the present invention is to provide a face mask, for use in a cold weather hood, which is relatively impervious to wind yet comfortable to wear.

Another object of the present invention is to provide a face mask, for use in a cold weather hood, which may be molded or shaped so as to match the contours of a user's face without being significantly stretched.

These and other objects and advantages are achieved in a face mask, for use in a cold weather hood, made from multiple layers of material. Preferably, the face mask has three layers of material—first and second layers of soft material and a third layer of relatively wind impervious material sandwiched therebetween. The third layer is made from rubber, closed-cell foam, or a similar material which may be molded or shaped to substantially conform to the contours of an average wearer's face. The face mask has openings for the wearer's eyes, nose, and mouth.

In the preferred embodiment, the face mask has a single opening for the wearer's eyes and an additional single opening for the wearer's nostrils and mouth.

The face mask is dimensioned and formed to cover the wearer's nose, and the opening for the wearer's nostrils and mouth is positioned and dimensioned so as to form a breathing aperture which exposes the nostrils of the wearer.

The face mask is suitable for use in a cold weather hood. Such a hood includes a cowl member adapted to cover a wearer's head. The cowl member has an opening and the face mask is secured in that opening.

Further objects and advantages of the present invention will become more apparent from the following detailed description of the invention taken in combination with the accompanying drawings.

BRIEF DESCRIPTION OF THE DRAWINGS

FIG. 1 is perspective view of a cold weather hood having a face mask constructed according to a preferred embodiment of the present invention.

FIG. 2 is a cross-sectional view of the cold weather hood having the face mask shown in FIG. 1 and taken along line 2—2 of FIG. 1.

FIG. 3 is an enlarged, partial detail of the cross-sectional view of the face mask shown in FIG. 2.

DETAILED DESCRIPTION

Figure 4:
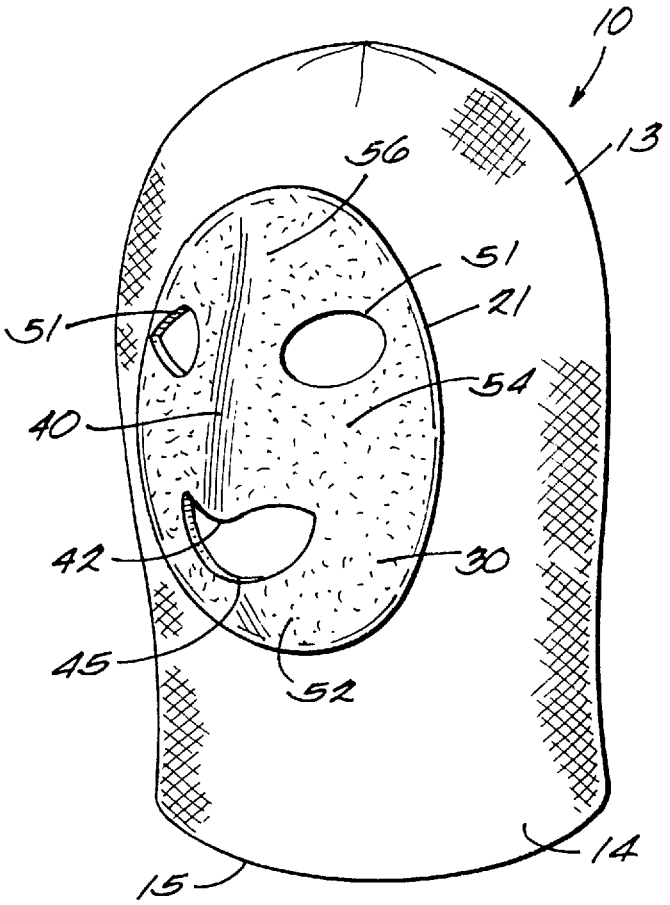
FIG. 4 is perspective view of a cold weather hood having a face mask constructed according to a second embodiment of the present invention.

According to the invention, a cold weather hood 10 is adapted to substantially enclose the head of a wearer, thereby protecting the wearer from the effects of a cold weather environment.

As shown in FIG. 1, the cold weather hood 10 has a cowl member 13 which includes an elongated neck portion 14 that defines a passageway 15. The cowl member 13 may be manufactured out of assorted knitted materials which may include both natural and various synthetic fibers. The passageway 15 is dimensioned so as to permit movement of the wearer's head through the passageway and into the cowl member 13. The cowl member 13 has an opening 20 which is defined by a periphery 21. The periphery 21 is positioned and dimensioned to extend along the forehead, across the temples, over the cheeks, and extends to a position just underneath the chin of a user when the hood 10 is worn.

A face mask 30 is secured in the opening 20 by conventional stitching or another suitable fastening technique. As best seen by reference to FIG. 2, the face mask 30 includes a first layer of material 32 and a second layer of material 33. The first and, in particular, the second layer of material are preferably made from material which is relatively soft and comfortable feeling when placed against a wearer's skin. As can be seen in the drawings, the second layer of material 33 is placed against a wearer's face when the hood 10 is worn. Suitable materials for the first and second layers 32 and 33 include cotton, polyester fleece, acrylic fleece, flannel, and other soft fabrics which are easily bondable to rubber or closed-cell foam. It has been found that the first and second layers may be made from brushed tricot. In another embodiment, the first layer and second layers are made from brushed acrylic fleece.

Sandwiched between the first and second layers 32 and 33 is a third layer of material 36. The third layer 36 is made from a material which is substantially impervious to wind and may be molded or shaped to substantially conform to the contours of an average wearer's face. Suitable materials for the third layer 36 include natural and synthetic rubber, specifically butyl and latex rubber, and closed-cell foam. Preferably, the material is one which may be hot vacuum formed in a face mold, but still maintains some flexibility after being molded. Thus, hard plastics and similar materials are not suitable for use in the present invention.

Generally, the mold used to form the third layer is a mold having positive and negative or male and female counterparts constructed according to calculations and estimates as to the shape and size of an average user's face, much in the same way as a last is developed for shoes. Several standard molds may be used so as to better match the face contours of men, women, and children, if desired, so as to form face masks of different sizes and shapes. While generally cost prohibitive, the third layer 36 may be custom formed in a mold of a specific user's face to provide a better fit. In the most preferred embodiment, the third layer 36 should be constructed from ⅛" thick sheet of latex rubber or similar material. The first and second layers 32 and 33 are bonded to the third layer 36. Then the multiple-layer structure is hot vacuum formed in a face mask mold to achieve the desired shape. This type of molding and bonding of rubber is known to those skilled in the art.

One of the features of the face mask 30 is a formed nose section 40. The nose section 40 is roughly triangular in shape and operable to shield or otherwise insulate a wearer's nose, thereby protecting it from the effects of a cold weather environment. One important characteristic of the face mask 30 is that the third layer 36 is formed so as to substantially conform to the contours of a wearer's face by means of the nose section 40.

The nose section 40 has a bottom edge 42 which partly defines an opening 45 in the face mask 30. The opening 45 is a breathing aperture and is positioned and dimensioned to expose the wearer's mouth and nostrils. However, the edge 42 is dimensioned to extend slightly beyond the tip of the wearer's nose so that, provided a face mask of proper size is worn by the wearer, the face mask 30 covers most of the length of the wearer's nose.

The face mask 30 includes an single opening 50 for the wearer's eyes. It is preferred that a single opening which partially exposes the wearer's nose be provided for the eyes so that eye glasses, sun glasses, goggles, etc. may be worn when the hood 10 is worn. However, as shown in FIG. 4, it possible to create a mask with two individual openings 51 for a wearer's eyes. In the embodiment of FIG. 4, substantially the entire length of the wearer's nose is covered by the face mask 30.

The face mask 30 also includes additional contour features including a chin section 52, cheek bone sections 54, and a forehead section 56. Each of these sections of the face mask 30 are formed and shaped to fit around these relatively prominent features of a wearer's face. Each of these sections is only slightly curved and formed so as to provide an enhanced fit to a user's chin, cheek bones, and forehead.

As noted above, the face mask 30 is made, in part, from a material like rubber which maintains some flexibility after being molded. It has been found that the face mask 30 provides an improved fit over prior-art devices because no stretching of material is required in order for the face mask to fit over prominent facial features such as the nose. This is accomplished because the face mask includes the molded or formed nose section 40, chin section 52, cheek bone section 54, and forehead section 56. The remainder of the face mask 30 and even the specifically formed sections are somewhat flexible providing the wearer some "give" in the mask. This feature facilitates putting the mask on and taking it off, particularly when the mask is placed in a cold weather hood. It should be understood that the formed sections are not necessarily dramatically curved or formed but may include only slight curves which provide an enhanced, contoured fit.

While the present invention has been described in what is believed to be the most preferred forms, it is to be understood that the invention is not confined to the particular construction and arrangement of the components herein illustrated and described, but embraces such modified forms thereof as come within the scope of the following claims.

What is claimed is:

1. A cold weather hood for use by a wearer, the hood comprising:

a cowl member adapted to cover a wearer's head and having an opening; and a face mask for covering the face of a wearer, secured in the opening of the cowl member, the face mask being molded from a single piece of multiple layer stitchless and seamless material so as to substantially conform to the contours of a wearer's face.

2. A cold weather hood as claimed in claim 1, wherein the multiple-layer material is a three-layer material having first and second layers of relatively soft material and a third layer of relatively wind impervious, substantially shape-retaining, moldable material sandwiched therebetween.

3. A cold weather hood as claimed in claim 2, wherein the third layer is formed and shaped to substantially conform to the contours of a user's chin, cheek bones, and forehead.

4. A cold weather hood as claimed in claim 2, wherein the face mask has a single opening for a wearer's eyes and a single opening for a wearer's nose and mouth.

5. A cold weather hood as claimed in claim 4, wherein the face mask is dimensioned and formed to cover at least a portion of a wearer's nose, and the opening for a wearer's nose and mouth defines a breathing aperture which exposes the nostrils of a wearer.

6. A cold weather hood as claimed in claim 2, wherein the third layer is made from closed cell foam.

7. A cold weather hood as claimed in claim 2, wherein the third layer is made from rubber.

8. A one-piece, stitchless, and seamless face mask mounted in a cold weather hood having a cowl member adapted to cover a wearer's head and including an opening around substantially the entire face of a wearer, the face mask covering substantially the entire face of a wearer and comprising:

a first layer of relatively soft material;

a second layer of relatively soft material;

a third layer of relatively wind impervious, substantially permanently moldable material sandwiched between the first and second layers of material and molded to substantially conform to the contours of a wearer's face.

9. A face mask as claimed in claim 8, wherein the face mask has a single opening for a wearer's eyes and a single opening for a wearer's nose and mouth.

10. A face mask as claimed in claim 9, wherein the face mask is dimensioned and formed to cover at least a portion of a wearer's nose, and the opening for a wearer's mouth and nose defines a breathing aperture which exposes the nostrils of a wearer.

11. A face mask as claimed in claim 10, wherein the third layer of material is made from rubber.

12. A face mask as claimed in claim 10, wherein the third layer of material is made from closed cell foam.

13. A face mask as claimed in claim 8, wherein the third layer is formed and shaped to substantially conform to the contours of a user's chin, cheek bones, and forehead.

14. A cold weather hood comprising:

a cowl adapted to cover a wearer's head and having a neck portion and a head portion, the neck portion dimensioned to permit a wearer's head to pass therethrough into the head portion;

a face mask mounted and secured within said head portion of said cowl the face mask being molded as a unitary seamless piece from a layered material and having apertures for a wearer's eyes and mouth, the layered material having inner, middle, and outer layers, the inner and outer layers being relatively soft material and the middle layer being relatively wind impervious, substantially shape retaining, and moldable;

a nose section formed within the face mask positioned so as to correspond to the location of the wearer's nose and dimensioned to cover substantially the entire length of a wearer's nose; and contour features molded into the face mask such that the face mask substantially conforms to a wearer's face, the contour features being curved so as to provide an enhanced fit of the face mask to a wearer's face.

* * * * *